United States Patent [19]

Lew

[11] Patent Number: 5,051,078

[45] Date of Patent: Sep. 24, 1991

[54] ROTARY PUMP-FLOWMETER

[76] Inventor: Hyok S. Lew, 7890 Oak St., Arvada, Colo. 80005

[21] Appl. No.: 375,466

[22] Filed: Jul. 5, 1989

[51] Int. Cl.[5] ..... F04C 18/234; F04C 2/234; G01F 3/08

[52] U.S. Cl. ..... 418/260; 73/260; 418/263; 418/268

[58] Field of Search ..... 418/256, 257, 261, 264, 418/265, 2, 268, 260; 73/260

[56] References Cited

U.S. PATENT DOCUMENTS

| | | | |
|---|---|---|---|
| 3,114,324 | 12/1963 | Baker | 418/264 |
| 3,373,723 | 3/1968 | Blosser | 418/265 X |
| 4,149,833 | 4/1979 | Baudin | 418/265 X |
| 4,212,603 | 7/1980 | Smolinski | 418/265 X |
| 4,299,546 | 11/1981 | Stout | 418/263 |
| 4,502,853 | 3/1985 | Ohi | 418/2 |
| 4,646,568 | 3/1987 | Lew | 418/268 X |
| 4,765,185 | 8/1988 | Lew | 418/268 X |
| 4,917,584 | 4/1990 | Sakamaki et al. | 418/256 |

FOREIGN PATENT DOCUMENTS

| | | | |
|---|---|---|---|
| 640856 | 7/1928 | France | 418/265 |
| 2188678 | 10/1987 | United Kingdom | 418/268 |

*Primary Examiner*—Leonard E. Smith

*Assistant Examiner*—David L. Cavanaugh

[57] ABSTRACT

A rotary pump-flowmeter comprises a body including a cylindrical cavity and a rotor assembly including at least one flange disposed within the cylindrical cavity in a rotatable arrangement about an axis of rotation parallel to and offset from the central axis of the cylindrical cavity and a plurality of flaps having a round first edge and a crescent second edge disposed about the axis of rotation and supported by the flange, wherein each of the plurality of flaps is pivotable about an axis of pivot parallel to and offset from the axis of the rotation and coinciding with the center of the radius defining the round first edge of the flap. Each individual flap includes at least one cam roller anchored to one end face of the flap in a rotatable arrangement about an axis parallel to and offset from the axis of the pivot of the flap. A cam guide groove included in a rotary member rotatable about an axis parallel to and offset from the axis of rotation of the rotor assembly guides the orbiting motions of the cam rollers about the axis of rotation in such a way that a clearance of small tolerance is maintained between the extremities of the crescent edges of the flaps and the inner cylindrical surface of the cylindrical cavity, wherein the rotary member is rotated by the rotating motion of the rotor assembly positively or frictionally.

12 Claims, 4 Drawing Sheets

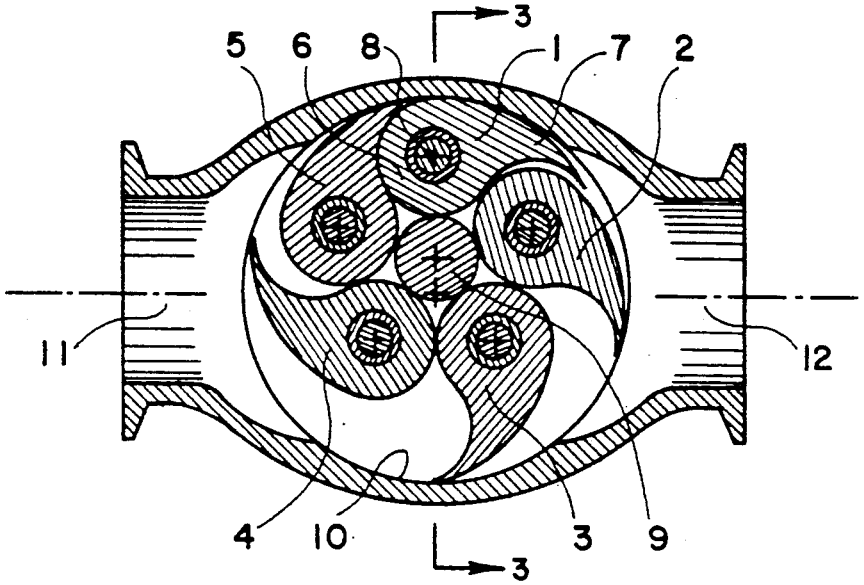
Fig. 1
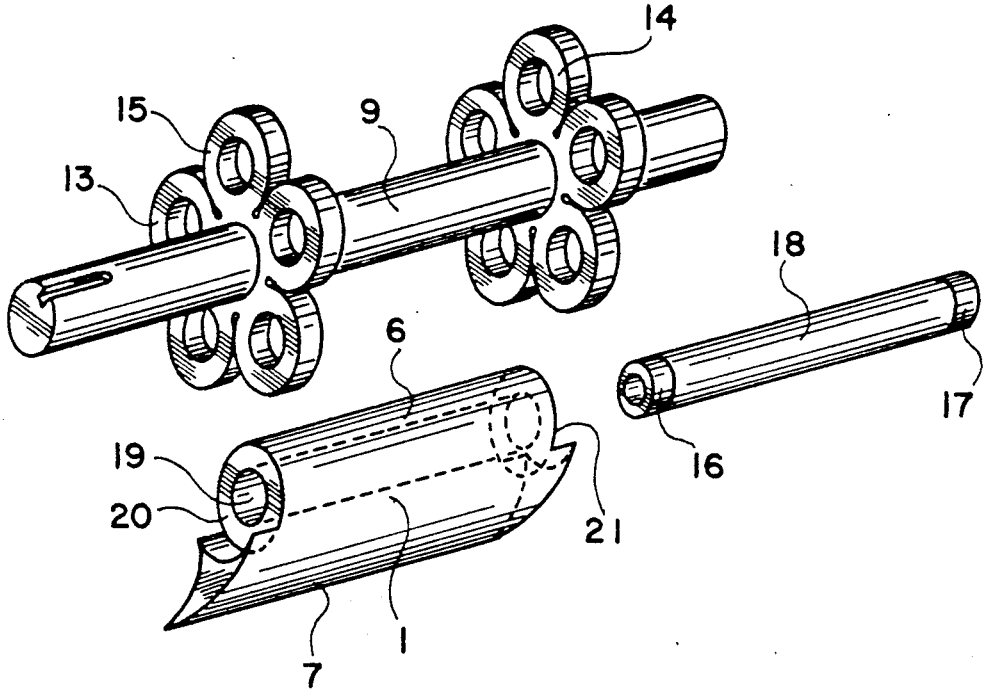
Fig. 2-a
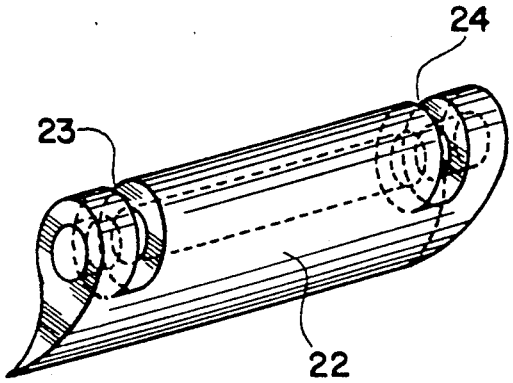
Fig. 2-b

ROTARY PUMP-FLOWMETER

BACKGROUND OF THE INVENTION

An apparatus for pumping and/or measuring flow comprises a plurality of flaps having a cross section of a round first edge and a crescent second edge extending therefrom, which flaps are disposed about an axis of rotation and supported by at least one flange rotatable about the axis of rotation, wherein each of the flaps is pivotable about a pivot axis passing through the center of the round edge thereof. The assembly of the flaps, which fold into a shape having a cross section with a generally circular periphery is disposed eccentrically in a cylindrical cavity in a rotating relationship about the axis of rotation, wherein an intake port is disposed through the wall of the first half of the cylindrical cavity and a discharge port is disposed through the second half of the cylindrical cavity. The retracting and extending motions of the flaps are guided by cam rollers following cam guide grooves included in a rotating member that is driven positively or frictionally by the rotating motion of the flap assembly, or by a rotatable ring limiting the extension of the flaps, which ring is driven frictionally by the rotating motion of the flap assembly.

There is a strong demand for a positive displacement pump providing a high volume flow with a medium pressure boost and a high volume flow positive displacement flowmeter with minimum pressure drop, wherein the positive displacement pump or flowmeter does not suffer from a high mechanical friction arising from moving elements under relative motions in rubbing relationships or from high fluid dynamic drag on the moving parts lacking streamlined geometry. A typical example of the applications of the positive displacement pump with a high flow rate and low friction loss is the super-charger for automobile engines as the state of the art in the automobile engine technology shows the advantage and preference of the super-charger over the turbo-charger. There are wide varieties of positive displacement flowmeters applied to all kinds of flow measurements in industry and commerce at the present time and, yet, most of these positive displacement flowmeters lack versatility because of the limitation thereof imposed by the high friction or low volume flow capacity inherent in these existing positive displacement flowmeters. The present invention teaches a positive displacement pump and/or flowmeter of a high volume flow capacity, that operates at a high efficiency as the energy loss due to friction on the moving elements in the pump or flowmeter is reduced to a minimum.

SUMMARY OF THE INVENTION

The primary object of the present invention is to provide a rotary pump and/or flowmeter that comprises a plurality of flaps having cross sections with a round first edge and a crescent second edge extending therefrom, which flaps are disposed about an axis of rotation in an arrangement wherein the round first edge of each of the flaps is disposed adjacent to the axis of rotation and pivotably supported in a pivoting arrangement about a pivot axis coinciding with the center of radius of the round first edge by one or more flanges rotatable about the axis of rotation, whereby the flaps fold into a combination having a generally circular periphery. The combination of the flaps and the flange supporting the flaps is disposed eccentrically within a cylindrical cavity including an intake port open to a first half of the cylindrical cavity and a discharge port open to a second half of the cylindrical cavity disposed on the opposite side of the first half thereof across a plane including the axis of rotation and the central axis of the cylindrical cavity. The tightly controlled tolerance between the sides of the assembly of flaps and the end face of the cylindrical cavity and the close tolerance between the round first edges of the flaps provide barriers against fluid lead therethrough. The tips of the crescent second edges of the flaps gliding on the internal cylindrical surface of the cylindrical cavity provides a barrier against the pressure difference created thereacross.

Another object is to provide a rotary pump and/or flowmeter including cam rollers anchored to the flaps, which cam rollers follow the cam guide grooves included in a rotating member which is positively or frictionally driven by the rotating flange supporting the flaps, wherein the cam rollers following the cam guide groove or grooves control the folding and unfolding motion of the flaps in such a way that the tips of the crescent second edges of the flaps glide along the inner cylindrical wall of the cylindrical cavity on a thin fluid film or directly thereon limiting the contact pressure therebetween to an acceptable value.

A further embodiment is to provide a rotary pump and/or flowmeter including one or more flanges mounted on a shaft, which flange has a lobed construction, wherein each of the lobes engages a receiving counterpart of the lobe included in the round first extremity of the flap and secured thereto in a pivoting arrangement, thereby exposing full end faces of the flaps or crescent extremity portions thereof for the installation of the cam rollers.

Yet another object is to provide a rotary pump and/or flowmeter including one or more rotating rings guiding a portion of the crescent second extremity of each flap, which rotating ring driven positively or frictionally by the flange supporting the flaps guides the crescent second edges of the flaps along the inner cylindrical surface of the cavity on a thin fluid film or directly thereon limiting the contact pressure therebetween to an acceptable value.

Yet a further object is to provide a rotary pump and/or flowmeter including one or more flanges of lobed construction supporting the flaps, wherein the combination of the lobed flange and flaps exposes a portion of the crescent second edges of the flaps for support thereof by the rotating ring.

Still another object is to provide a rotary pump and/or flowmeter including one or more rollers anchored to each flap, which rollers roll on a rotating or stationary ring or rings, which guide the tips of the crescent second edges of the flaps along the inner cylindrical surface of the cavity on a thin fluid film or directly thereon with limited contact pressure therebetween.

These and other objects of the present invention will become clear as the description thereof progresses.

BRIEF DESCRIPTION OF THE FIGURES

The rotary pump and/or flowmeter of the present invention may be describd with great clarity and specificity by referring to the following figures.

FIG. 1 illustrates a cross section of the rotary pump and/or flowmeter of the present invention showing the fundamental construction thereof.

FIGS. 2-*a* and -*b* illustrates a perspective view of a supporting structure including a shaft and one or more flanges of lobed construction, which combination supports the flaps; an embodiment of the flap and pin connecting the flap to the flange in a pivoting arrangement; and another embodiment of the flap.

DESCRIPTION OF THE ILLUSTRATED EMBODIMENTS

Figure 3:
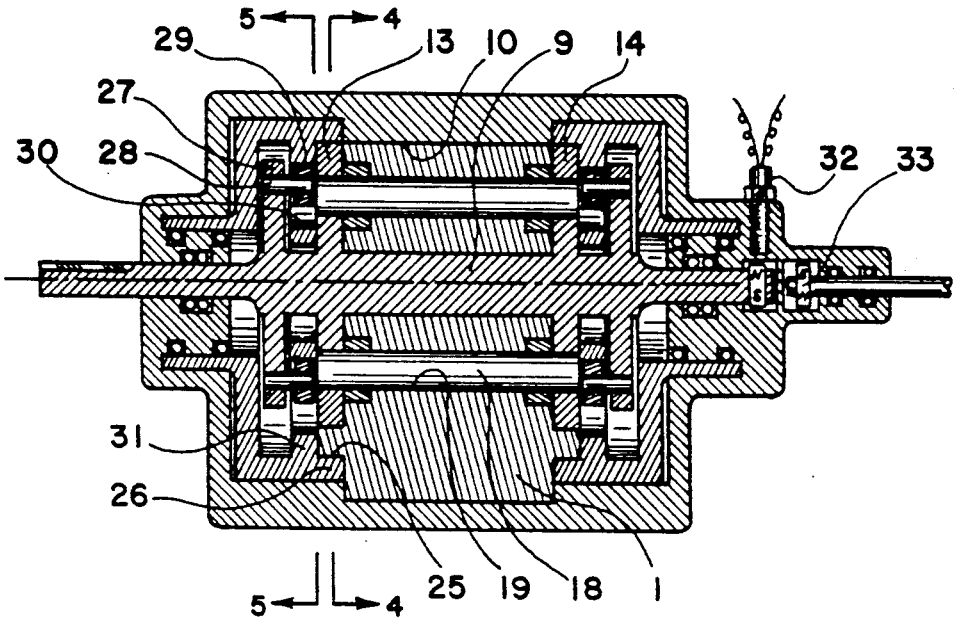
FIG. 3 illustrates a cross section of an embodiment of the rotary pump and/or flowmeter, which cross section is taken along plane 3—3 including the axis of rotation of the flap assembly as shown in FIG. 1.

In FIG. 1 there is illustrated a cross section of an embodiment of the rotary pump and/or flowmeter constructed in accordance with the principles of the present invention, which cross section taken along a plane including the central axis of the rotor assembly shows the fundamental construction of the rotary pump and/or flowmeter. The rotor assembly comprises a plurality of flaps 1, 2, 3, 4, 5, etc., each of which has a cross section geometry including a round first edge 6 with a partial circular periphery and a crescent second edge 7 extending from the round first edge 6, wherein the individual flap is supported in a pivoting arrangement about a pivot axis 8 coinciding with the center of radius of the partial circular periphery of the round first edge 6 by one or more flanges affixed or mounted on a shaft 9. The flaps 1, 2, 3, 4, 5, etc. pivot into a folded configuration having a cross section shape with a circular periphery concentric about the axis of rotation coinciding with the central axis of the shaft 9. The rotor assembly comprising the flaps, 1, 2, 3, 4, 5, etc., and the supporting flanges affixed or mounted on the shaft 9 is disposed within a cylindrical cavity 10 in an eccentric arrangement, wherein the minor radius from the axis of rotation to the inner cylindrical surface of the cylindrical cavity 10 is generally equal to or slightly greater than the radius of the circular periphery of the fully folded assembly of the flaps, while the major radius is sizably greater than the radius of the circular periphery of the fully folded assembly of the flaps. A first port 11 is open to the first half of the cylindrical cavity 10, while a second port 12 is open to the second half of the cylindrical cavity 10, wherein the two halves of the cylindrical cavity are disposed on the two opposite sides of a plane including the axis of rotation of the flap assembly and the central axis of the cylindrical cavity. The shaft 9 is rotatably supported by the two side walls of the cylindrical cavity. The clearance between the end face of the rotor assembly and the end wall of the cylindrical cavity 10 has a close tolerance, and the tips of convex side surfaces of the crescent second edges of the flaps move along the inner cylindrical surface of the cylindrical cavity maintaining a close tolerance therebetween. The gap between the round first edges of two adjacent flaps and/or the gap between the round first edges of the flaps and the circular cylindrical surface of the shaft 9 have a close tolerance. As a consequence, at least two flaps generally located at two diametrically opposite positions about the axis of rotation always separate the first and second halves of the cylindrical cavity in a generally leak-proof manner in all instances of the rotation of the rotor assembly. It should be mentioned that a seal having a star-shaped cross section filling the space between the flaps and the shaft and mounted on the shaft 9 may be employed in order to open up the clearance between the round first edges of the flaps or between the round first edges of the flaps and the shaft 9. It should be mentioned that the number of flaps included in the rotor assembly may be equal to or greater than three depending on design and operating criteria. In order to function efficiently and effectively as a positive displacement pump and/or flowmeter, the flaps must fold and unfold as shown in FIG. 1 during their orbiting motion about the axis of rotation. The present invention addresses a solution that makes the flaps unfold as much as possible, yet limits the friction and the contact pressure between the tips of the crescent second edges of the flaps and the inner cylindrical surface of the cylindrical cavity 10.

Figure 6:
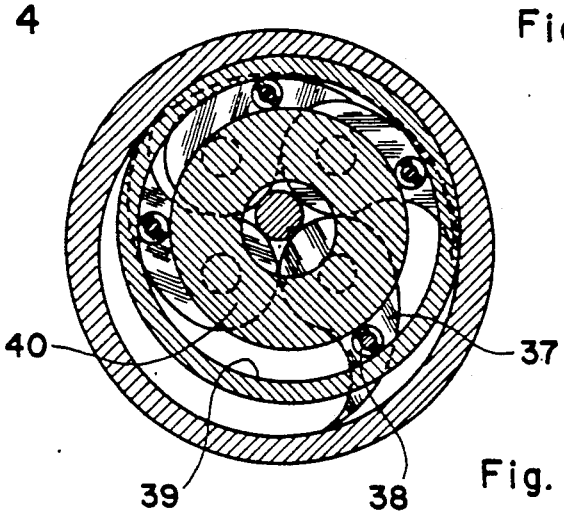
FIG. 6 illustrates a cross section of another embodiment of the rotary pump and/or flowmeter, which cross section is equivalent to that shown in FIG. 4.
Figure 8:
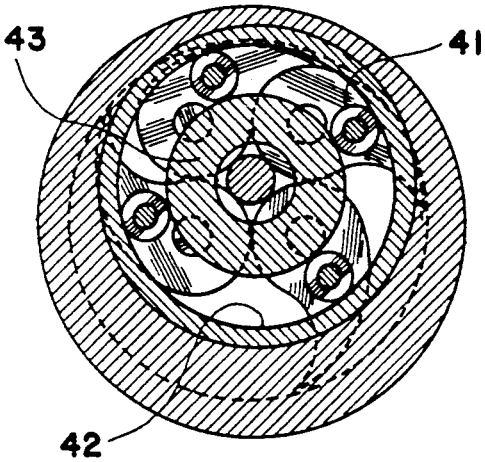
FIG. 8 illustrates another cross section of the embodiment shown in FIG. 7 which cross section is taken along plane 8—8 as shown in FIG. 7.
Figure 9:
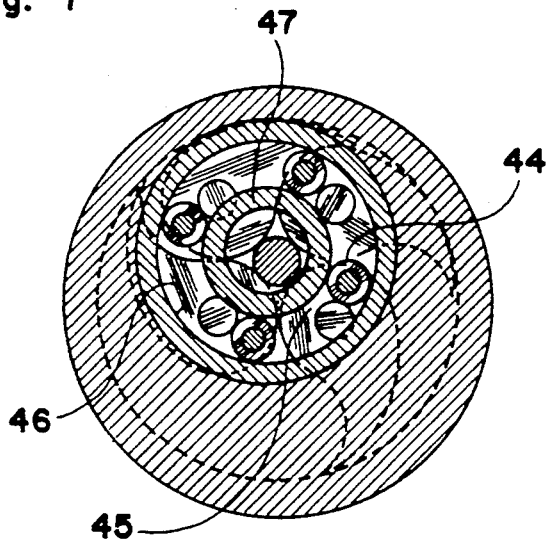
FIG. 9 illustrates a cross section of yet another embodiment of the rotary pump and/or flowmeter, which cross section is equivalent to that shown in FIG. 8.
Figure 10:
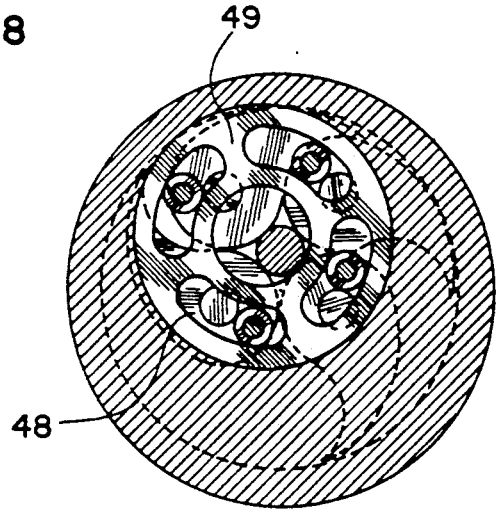
FIG. 10 illustrates a cross section of yet a further embodiment of the rotary pump and/or flowmeter, which cross section is equivalent to that shown in FIG. 8.

In FIGS. 2-*a* and -*b* there is illustrated a perspective view showing the fundamental elements constituting the rotor assembly, which comprises a shaft 9 including a pair of flanges 13 and 14 having a lobed construction including a plurality of generally circular lobes 15 with a radius matched to the radius of the circular periphery of the round first edge in the cross section of the flap, which lobes 15 are disposed axisymmetrically about the shaft 9. The center of radius of the lobe 15 includes a hole for receiving one of the two bearings 16 and 17 respectively mounted on the two extremities of the rod 18, that is to engage through a clearnace hole 19 passing through the center of radius of the circular periphery of the round first edge 6 of the flap 1 that includes the crescent second edge 7. The two end faces of the flap 1 respectively include two recessed areas 20 and 21 around the hole 19, which recessed areas 20 and 21 are to receive lobes included in the flanges 13 and 14 in a close tolerance relationship. The rotor assembly including the flaps connected to the flanges 13 and 14 takes the shape of a generally solid circular cylinder when all of the flaps are fully folded, which solid circular cylinder has two flush generally solid end faces and a generally circular cylindrical surface. As an alternative to the flap 1, a plurality of flaps having a design of flap 22 may be employed in the construction of the rotor assembly. The flap 22 having the same cross section as the cross section of the flap 1 has a pair of cut-ins 23 and 24 disposed intermediate the two end faces thereof, which are for receiving the lobes included in the flanges 13 and 14 in a close tolerance relationship. In the rotor assembly comprising the type of flap 1, only the crescent edge portions of the end faces of the flaps are exposed in an arrangement flush to the outer surface of the flange at the two end faces of the rotor assembly and, consequently, a cam roller must be affixed on that portion of the end face of each flap as shown in FIG. 6. On the other hand, in the rotor assembly comprising a plurality of the flaps 22, the entire end faces of the flaps are exposed and, consequently, the cam roller can be affixed to any portion of the end face of the flap as shown in FIGS. 8, 9 and 10.

In FIG. 3 there is illustrated a cross section of an embodiment of the rotary pump-flowmeter comprising a plurality of flaps as shown in FIG. 1, which cross section is taken along a plane including the axis of rotation of the rotor assembly. The rotor assembly includes the shaft 9 with flanges 13 and 14, which supports a plurality flaps of the type 1 shown in FIG. 2. As a variation in design, the two bearings mounted on the rod 18 engage the two counter bores respectively included at the two extremities of the hole instead of the holes included in the flanges 13 and 14. In this particular embodiment, each end face of the crescent edge of the flap includes a recessed tip providing a shoulder 25 that is resting on the inner cylindrical surface of a circular guide ring 26 disposed in a rotatable arrangement about the central axis thereof eccentric to the axis of the rotation of the rotor assembly as well as to the central axis of the cylindrical cavity 10. The two guide rings respectively disposed at the two extremities of the cylindrical cavity 10 and supporting the shoulders included in the end faces of the crescent edges of the flaps are positively driven by the flanges 13 and 14, respectively. A driving disc 27 affixed to the shaft 9 in a coaxial arrangement includes a plurality of posts 28 supporting rollers 29, which are disposed axisymmetrically about the shaft 9. Each of these rollers 29 engages each of a plurality of over-sized holes 30 included in a driven disc 31 affixed to the guide ring, wherein the over-sized holes are disposed axisymmetrically about the central axis of the circular guide ring 26. The circular guide rings guide the folding and unfolding motion of the flaps in such a way that the tips of the crescent edges of the flaps glide along the inner cylindrical surface of the cylindrical cavity without experiencing solid-to-solid surface friction. It should be understood that the positive driving mechanism comprising the driving and driven discs 27 and 31, and the posts 28 and the rollers 29 may be omitted in an alternative embodiment, wherein the circular guide ring 26 is driven frictionally by the shoulder 25 included in the end face of the crescent edge of the flap resting thereon. When the rotary pump-flowmeter is used as a flowmeter, the rotary speed sensor 32 or the rotary motion transmission 33 provides the information on the rotary speed of the rotor assembly as a measure of the volume flow rate.

Figure 4:
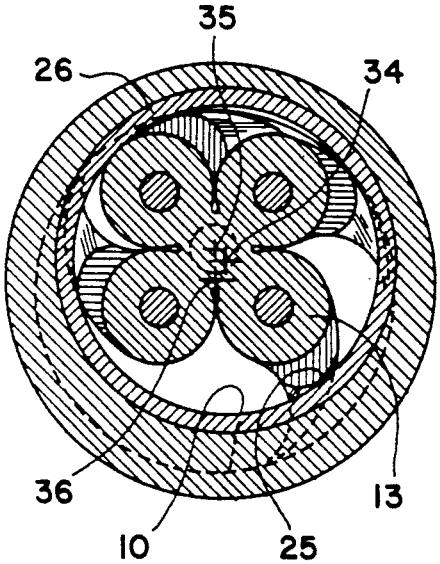
FIG. 4 illustrates another cross section of the embodiment shown in FIG. 3 which cross section is taken along plane 4—4 as shown in FIG. 3.

In FIG. 4 there is illustrated another cross section of the embodiment shown in FIG. 3, which cross section is taken along a plane 4—4 as shown in FIG. 3. The circular guide ring 26 rotating about its own central axis 34 eccentric to the central axis 35 of the rotor assembly as well as to the central axis 36 of the cylindrical cavity 10 supports the shoulder 25 included in the end face of the crescent edge of each of the plurality of flaps included in the rotor assembly in such a way that the tips of the crescent edges of the flaps glide on the inner cylindrical surface of the cylindrical cavity 10 without experiencing a high solid-solid interface friction.

Figure 5:
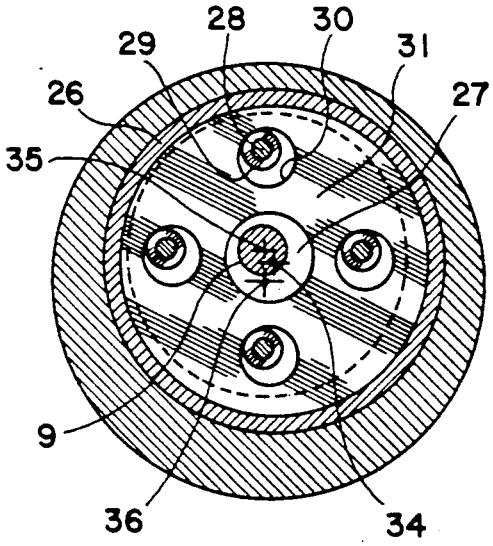
FIG. 5 illustrates a further cross section of the embodiment shown in FIG. 3 which cross section is taken along plane 5—5 as shown in FIG. 3.

In FIG. 5 there is illustrated a further cross section of the embodiment shown in FIG. 3, which cross section is taken along plane 5—5 as shown in FIG. 3. The driven disc affixed to the circular guide ring 26 includes a plurality of over-sized holes disposed in an axisymmetric arrangement about the central axis 34 of the circular guide ring 26, which over-sized holes are respectively engaged by the roller 29 rotatably mounted on the posts 28 axisymmetrically disposed about the axis 35 of rotation of the rotor assembly and affixed to the driving disc 27. In an alternative embodiment wherein the circular guide ring is driven frictionally, the positive driving mechanism shown in FIG. 5 is omitted.

In FIG. 6 there is illustrated a cross section of another embodiment of the rotary pump-flowmeter, which cross section is equivalent to the cross section shown in FIG. 4. In this embodiment, the end face 37 of the crescent edge of each flap includes a cam roller 38 following a circular cam guide groove 39 included in a rotating disc 40 disposed rotatably about the central axis thereof, which rotating disc 40 may be driven positively by the mechanism shown in FIG. 5 or frictionally as stated in the last paragraph in the description of FIG. 5.

Figure 7:
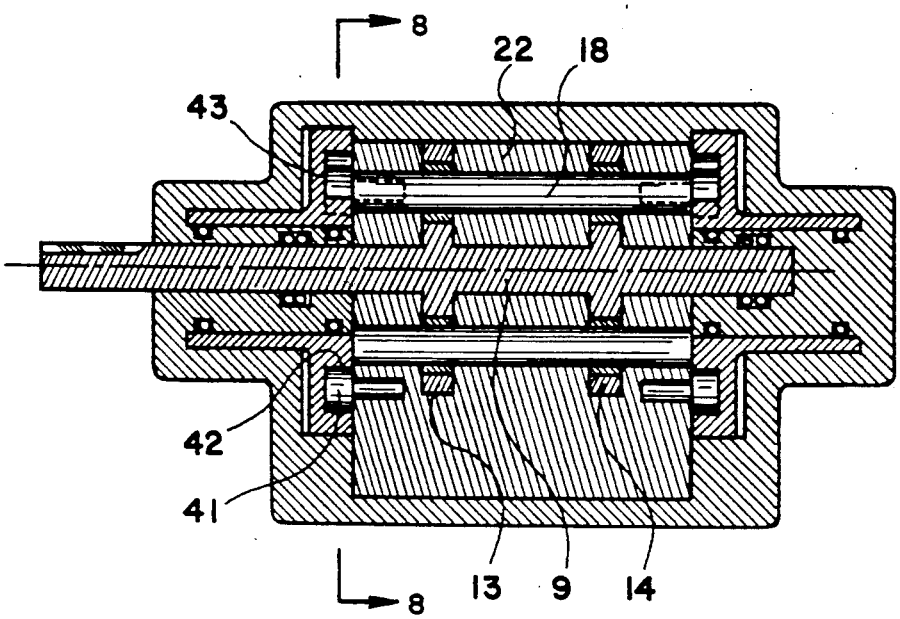
FIG. 7 illustrates a cross section of a further embodiment of the rotary pump and/or flowmeter.

In FIG. 7 there is illustrated a cross section of a further embodiment of the rotary pump-flowmeter comprising a rotor assembly including a plurality of flaps of the type 22 shown in FIG. 2. A cam roller 41 installed on each end face of the flap in an eccentric arrangement with respect to the pivot axis of the flap engages a circular cam guide groove 42 included in a rotating disc 43 disposed in a rotating relationship about the central axis of the circular cam groove 42, wherein the rotating disc 43 is driven frictionally by the cam rollers 41 orbiting the shaft 9 in this particular embodiment. In an alternative embodiment, the rotating disc 43 may be positively driven by the driving mechanism such as that shown in FIG. 5.

In FIG. 8 there is illustrated another cross section of the embodiment shown in FIG. 7, which cross section is taken along plane 8—8 as shown in FIG. 7. The circular cam guide groove 42 included in the rotating disc 43 guides the cam rollers 41 connected to the sides of the flaps in such a way that the tips of the crescent edges of the flaps glide on the inner cylindrical surface of the cylindrical cavity without experiencing any significant amount of solid-solid interface friction. The rotating disc 43 may be driven positively or frictionally by the rotating motion of the rotor assembly. It should be noticed that, as the entire end face of each of the plurality of flaps is exposed, a cam roller can be installed on any portion of the end face of the flap as long as it is eccentric to the pivot axis of flap. In this particular embodiment, the cam roller is disposed adjacent to the pivot axis of the flap intermediate the crescent edge and the pivot axis of the flap.

In FIG. 9 there is illustrated a cross section of yet another embodiment of the rotary pump-flowmeter, which cross section is equivalent to the cross section shown in FIG. 8. In this embodiment the cam roller 44 is installed in the round first edge portion 45 of the end face of the flap instead of the crescent second edge portion thereof in a adjacent relationship to the pivot axis of the flap, which arrangement results in a circular cam guide groove 46 of a smaller radius that provides an advantage in term of reduced rotary speed of the cam disc 47. The rotating plate 47 may be driven positively or frictionally by the rotating motion of the rotor assembly.

In FIG. 10 there is illustrated a cross section of yet a further embodiment of the rotary pump-flowmeter, which cross section is equivalent to the cross section shown in FIG. 9, which embodiment includes the same arrangement of the cam rollers as the embodiment shown in FIG. 9 with one exception being that the cam guide groove comprises a plurality of arcurate cut-outs 48 included in a relatively thin rotating disc 49 in place of the continuous circular groove. As a consequence, the cam rollers guided by the cam guide groove 48 drives the rotating disc 49, which feature provides a very important advantage in simplifying the construction of the rotary pump-flowmeter and in boosting the operating efficiency thereof.

Figure 11:
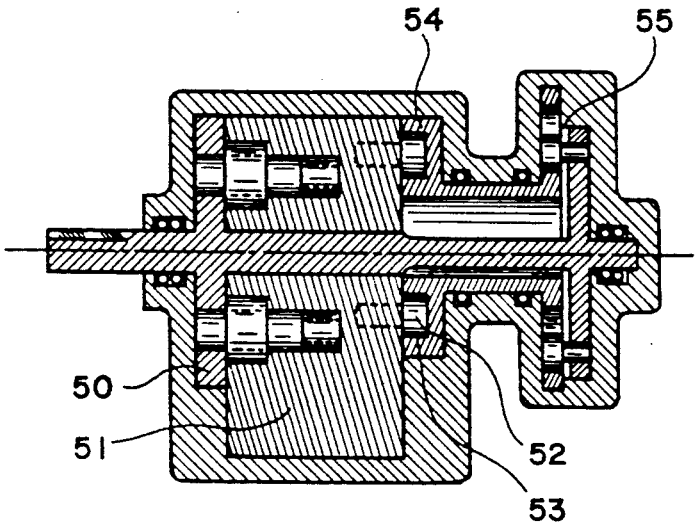
FIG. 11 illustrates a cross section of still another embodiment of the rotary pump and/or flowmeter.

In FIG. 11 there is illustrated a cross section of still another embodiment of the rotary pump-flowmeter, wherein the rotor assembly comprises a single flange 50 supporting a plurality of flaps 51 in a pivoting arrangement. The flaps 51 included in this embodiment having simple flat end faces do not include any recessed areas 20 and 21 in the end faces or cut-ins 23 and 24 shown in FIG. 2. The cam roller 52 installed on one end face of the flap opposite to the other end face adjacent to the flange 50 engages a circular cam guide groove 53 included a rotating disc 54 that is positively driven by the rotary motion coupling mechanism 55 shown in and described in conjunction with FIG. 5. In an alternating embodiment, the rotating disc 54 may be driven frictionally, wherein the rotary motion coupling mechanism is omitted. In another embodiment, the rotating disc 54 may have the same construction as the element 49 shown in FIG. 10, wherein the rotating disc is driven by the cam rollers engaging the segmented arcurate cam guide grooves. It should be understood that the single flange 50 may support another plurality of flaps disposed in an assembly that is a mirror image to the embodiment shown in FIG. 11 about a plane including the single flange 50.

Figure 12:
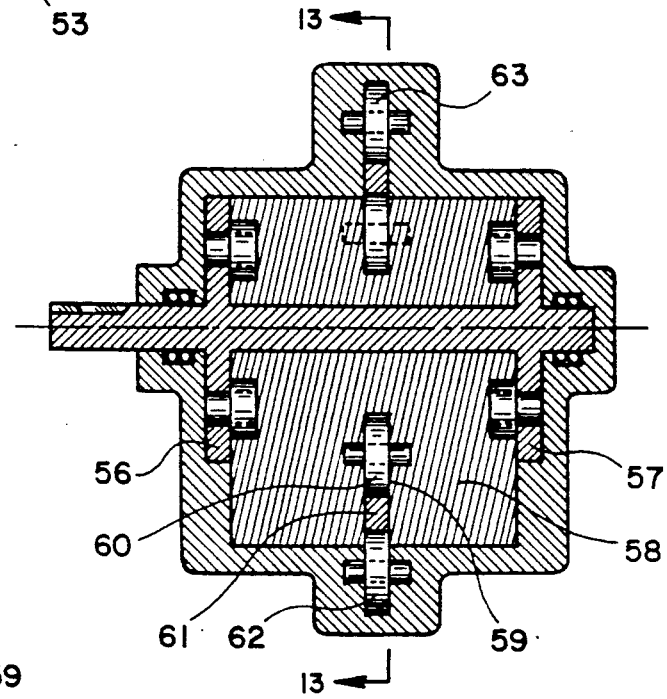
FIG. 12 illustrates a cross section of still a further embodiment of the rotary pump and/or flowmeter.

In FIG. 12 there is illustrated a cross section of still a further embodiment of the rotary pump flowmeter, which embodiment comprises a plurality of flaps having simple flat end faces without any cut-outs or cut-ins, which are disposed intermediate two flanges 56 and 57 and supported thereby in a pivoting arrangement. The midsection of each of the plurality of flaps 58 includes a cut-in 59 partially extending from the crescent second edge towards the round first edge of the flap, which cut-in accomodates a roller 60 rotatably anchored to the flap and rolling on a circular ring 61 retained in place by a plurality of retainer rollers 62, 63, etc.

Figure 13:
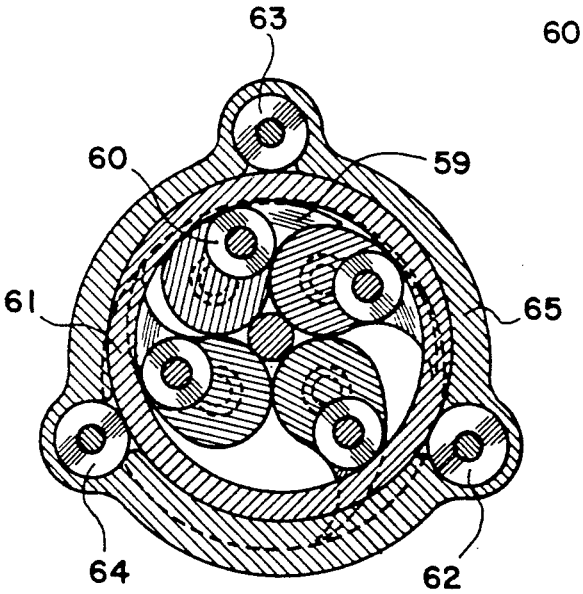
FIG. 13 illustrates another cross section of the embodiment shown in FIG. 12 which cross section is taken along plane 13—13 as shown in FIG. 12.

In FIG. 13 there is illustrated another cross section of the embodiment shown in FIG. 12, which cross section is taken along plane 13—13 as shown in FIG. 12. The plurality of rollers 60 respectively installed in the cut-ins 59 and rolling on the circular ring 61 ensures a gliding motions of the tips of the crescent edges of the flaps without experiencing any significant amount of solid-solid interface friction. The circular ring 61 is rotatably supported by a plurality of retainer rollers 62, 63, 64, etc. anchored to the shell structure 65 including the cylindrical cavity housing the rotor assembly in an eccentric and rotating relationship.

In summary, it should be emphasized that the rotating cam guide grooves, or the rotating ring supporting the rollers anchored to the flaps or the crescent edges of the flaps guided by a rotating ring constitute the most novel features of the present invention, as this feature ensures the nearly frictionaless high speed rotation of the rotor assembly without subjecting it to the very destructive solid-solid interface friction that would accompany the sliding motions of the crescent edges of the flaps relative to the inner cylindrical surface of the cylindrical cavity housing the rotor assembly in an eccentric relationship in the absence of the rotating cam guide groove or the rotating ring. In certain applications wherein the rotor assembly rotates at low rotary speeds, a stationary cam guide groove or guide ring may be employed in place of the rotating counterpart thereof. It should be mentioned that the shaft supporting the flange retaining the flaps in a pivoting relationship has to extend to the exterior of the shell including the cylindrical cavity in a pumping application, whereby the power source driving the rotary pump is coupled to the shaft. On the other hand, in a flow measuring application, the shaft should be terminated within the shell in order to eliminate the need for a rotary seal, as the rotary speed of the rotor assembly can be measured by a sensor or magnetic rotary transmission providing a coupling across a solid wall. A rotating ring as employed in the embodiments shown in FIGS. 4 or 12 may support the tips of the crescent edges of the flaps in lieu of the shoulder or roller employed in the particular illustrated embodiments. As the rotating cam guide groove or the rotating ring makes the crescent edges of the flaps follow the inner cylindrical surface of the cylindrical cavity in a close tolerance, the rotor assembly can be rotated in either of the two possible directions in pumping or flow measuring applications.

While the principles of the present invention have now been made clear by the illustrative embodiments, it will be immediately obvious to those skilled in the art that many modifications of the structures, arrangements, proportions, elements, and materials can be resorted to which are particularly adapted to the specific working environments and operating conditions, without departing from the operating principles of the present invention. It is not desired to limit the inventions to the particular illustrative embodiments shown and described, and accordingly, all suitable modifications and equivalents may be resorted to falling within the scope of the inventions as defined by the claims which follow.

The embodiments of the invention in which an exclusive property or priviledge is claimed, are defined as follows:

1. A rotary apparatus comprising in combination:

a) a housing including a cylindrical cavity having a smoothly contoured cross section;

b) a rotor assembly including at least one rotary support member disposed within the cylindrical cavity in a rotatable arrangement about an axis of rotation parallel to and off-set from the central axis of the cylindrical cavity, and a plurality of flaps, each of said plurality of flaps having a generally round first edge located adjacent to the axis of rotation and a crescent second edge, disposed within the cylindrical cavity about the axis of rotation and supported by the rotary support member in a pivotable arrangement respectively about axes of pivot respectively coinciding with the centers of radius of the generally round first edges of the plurality of flaps and disposed parallel to and axisymmetrically about the axis of rotation, wherein the plurality of flaps fold into a combination having a generally circular cylindrical peripheral surface;

c) a plurality of cam followers respectively included in the plurality of flaps, wherein each of the plurality of flaps has at least one cam follower disposed eccentrically to the axis of pivot of said each of the plurality of flaps;

d) at least one rotary cam member disposed adjacent and exposed to the cylindrical cavity in a rotatable arrangement about a cam axis parallel to and off-set from the axis of rotation, and including a cam guide guiding the plurality of cam followers following a circular path coaxial to the cam axis for maintaining a close tolerance between the crescent second edges of the plurality of flaps and cylindrical wall of the cylindrical cavity, wherein said rotary cam member includes two stepped diameters comprising a larger diameter section including said cam guide and a smaller diameter section extending axially into and rotatably supported by the housing by means of a rotary bearing;

e) a pair of flow passages respectively open to two halves of the cylindrical cavity respectively located on two opposite sides of a hypothetical plane generally including the axis of rotation and the central axis of the cylindrical cavity; and f) a rotary motion coupling means for transmitting a rotating motion to and from the rotor assembly.

2. A combination as set forth in claim 1 wherein said cam guide comprises a continuous circular guide coaxial to the cam axis and engaged by the plurality of cam followers.

3. A combination as set forth in claim 2 wherein said rotary cam member is disposed in a freely rotatable arrangement, whereby friction between the plurality of cam followers and the cam guide transmits rotating motion of the rotor assembly to the rotary cam member.

4. A combination as set forth in claim 2 wherein said combination includes a mechanical rotary motion coupling means transmitting rotating motion of the rotor assembly to the rotary cam member.

5. A combination as set forth in claim 1 wherein said cam guide comprises a plurality of discrete arcuate guides disposed coaxially about the cam axis, wherein each of the plurality of discrete arcuate guides receives at least one of the plurality of cam followers.

6. A combination as set forth in claim 5 wherein said combination includes a mechanical rotary motion coupling means transmitting rotating motion of the rotor assembly to the rotary cam member.

7. A rotary apparatus comprising in combination:

a) a housing including a cylindrical cavity having a smoothly contoured cross section;

b) a rotor assembly including at least one rotary support member disposed within the cylindrical cavity in a rotatable arrangement about an axis of rotation parallel to and off-set from the central axis of the cylindrical cavity, and a plurality of flaps, each of said plurality of flaps having a generally round first edge located adjacent to the axis of rotation and a crescent second edge, disposed within the cylindrical cavity about the axis of rotation and supported by the rotary support member in a pivotable arrangement respectively about axes of pivot respectively coinciding with the centers of radius of the generally round first edges of the plurality of flaps and disposed parallel to and axisymmetrically about the axis of rotation, wherein the plurality of flaps fold into a combination having a generally circular cylindrical peripheral surface;

c) a plurality of cam followers respectively included in the plurality of flaps, wherein each of the plurality of flaps has at least one cam follower disposed eccentrically to the axis of pivot of said each of the plurality of flaps;

d) at least one rotary cam member disposed adjacent and exposed to the cylindrical cavity in a rotatable arrangement about a cam axis parallel to and off-set from the axis of rotation, and including a cam guide guiding the plurality of cam followers following a circular path coaxial to the cam axis for maintaining a close tolerance between the crescent second edges of the plurality of flaps and cylindrical wall of the cylindrical cavity, wherein said rotary cam member includes two stepped diameters comprising a larger diameter section including said cam guide and a smaller diameter section extending axially into and rotatably supported by the housing by means of a rotary bearing;

e) a pair of flow passages respectively open to two halves of the cylindrical cavity respectively located on two opposite sides of a hypothetical plane generally including the axis of rotation and the central axis of the cylindrical cavity; and f) a rotary motion measuring means for measuring rotating speed of the rotor assembly as a measure of flow rate of media moving through the apparatus.

8. A combination as set forth in claim 7 wherein said cam guide comprises a continuous circular guide coaxial to the cam axis and engaged by the plurality of cam followers.

9. A combination as set forth in claim 8 wherein said rotary cam member is disposed in a freely rotatable arrangement, whereby friction between the plurality of cam followers and the cam guide transmits rotating motion of the rotor assembly to the rotary cam member.

10. A combination as set forth in claim 8 wherein said combination includes a mechanical rotary motion coupling means transmitting rotating motion of the rotor assembly to the rotary cam member.

11. A combination as set forth in claim 7 wherein said cam guide comprises a plurality of discrete arcuate guides disposed coaxially about the cam axis, wherein each of the plurality of discrete arcuate guides receives at least one of the plurality of cam followers.

12. A combination as set forth in claim 11 wherein said combination includes a mechanical rotary motion coupling means transmitting rotating motion of the rotor assembly to the rotary cam member.

* * * * *